United States Patent [19]

Faccia

[11] Patent Number: 4,984,900

[45] Date of Patent: Jan. 15, 1991

[54] MIXER PARTICULARLY FOR FIBROUS PRODUCTS

[76] Inventor: Tiziano Faccia, Via Padova 102, 35026 Conselve (Provincia di Padova), Italy

[21] Appl. No.: 377,667

[22] Filed: Jul. 10, 1989

[30] Foreign Application Priority Data

Jul. 11, 1988 [IT] Italy ..... 41637 A/88

[51] Int. Cl.[5] ..... B01F 7/24

[52] U.S. Cl. ..... 366/305; 366/309; 366/323

[58] Field of Search ..... 366/309, 88, 89, 67, 366/79, 96, 97, 98, 156, 171, 302, 304, 305, 309, 312, 318, 320, 323, 324; 28/295, 296

[56] References Cited

U.S. PATENT DOCUMENTS 1,727,672 11/1928 Quick ..... 366/309

1,760,374 2/1926 Pepper ..... 366/98

2,306,245 12/1942 Duke ..... 366/98

FOREIGN PATENT DOCUMENTS 48407 7/1984 Fed. Rep. of Germany .

2186810 9/1987 United Kingdom .

*Primary Examiner*—Robert W. Jenkins

*Attorney, Agent, or Firm*—Guido Modiano; Albert Josif

[57] ABSTRACT

The mixer is of the kind composed of a container which is internally provided with one or more vertical screws welded to a shaft which rotates about end pins fixed to the container. The improvements consist in a scraping element which is fixed to one of the pins and extends longitudinally flanking the shaft. Each scraping element has a blade which is rigidly associated therewith and scrapes the surface of the shaft and blade which is spaced from the surface.

6 Claims, 2 Drawing Sheets

MIXER PARTICULARLY FOR FIBROUS PRODUCTS

BACKGROUND OF THE INVENTION

The present invention relates to improvements to a mixer which is particularly usable for fibrous products in the zootechnical field but can also be used in the industrial field.

Mixers are currently known which are substantially constituted by a supporting base which is fixed or downwardly provided with wheels which allow its transport, above which a container is bolted or welded and is internally provided with one or more vertical mixing screws, each whereof is welded to an axial shaft which is rotationally associated with end pivots and is rotated by appropriate mechanical transmissions connected to actuation elements.

In particular, each screw has a spiral-shaped profile which is arranged along an ideal conical surface and therefore tapers from the bottom toward the top and ends at a position which is spaced from the top of said shaft.

The screw may conveniently be provided on its profile with blades adapted to shred the fibrous products during rotation.

During the operation of said mixers, the screw forces the loaded to rise toward the apex of the screw itself; when the product reaches said top, it falls downward to resume its rising motion, since the transport means which forced it to rise are no longer acting.

Though they optimally achieve their purposes, said known mixers, in particular for fibrous products such as hay and straw, have a disadvantage which consists in the easy tangling of said products around the portion of shaft which is arranged above the top of the screw.

Said tangling occurs in particular if the mixed products are moist.

Such a disadvantage entails the need to periodically stop the mixing and clean the shaft.

SUMMARY OF THE INVENTION

The aim of the present invention is to eliminate the above described disadvantage by providing improvements capable of performing the complete and continuous cleaning of the shaft of each screw during operation.

Within the scope of the above described aim, an important object is to provide improvements which can be easily and rapidly applied to known mixer trailers.

Not least object is to provide improvements composed of simple elements which are readily available and which can be assembled rapidly.

This aim, these- objects and others which will become apparent hereinafter are achieved by improvements to a mixer particularly for fibrous products, of the kind composed of a mixing container internally provided with at least one vertical screw, each whereof is welded to a shaft which rotates about end pins fixed to said container, characterized in that it comprises at least one scraping element which is fixed to at least one of said pins and extends longitudinally adjacent to said shaft, said at least one scraping element having at least one blade which is rigidly associated therewith and scrapes the surface of said shaft and at least one blade which is spaced from said surface.

BRIEF DESCRIPTION OF THE DRAWINGS

Further characteristics and advantages of the invention will become apparent from the detailed description of an embodiment, illustrated only by way of non-limitative example in the accompanying drawings, wherein.

DESCRIPTION OF THE PREFERRED EMBODIMENTS

Figure 1:
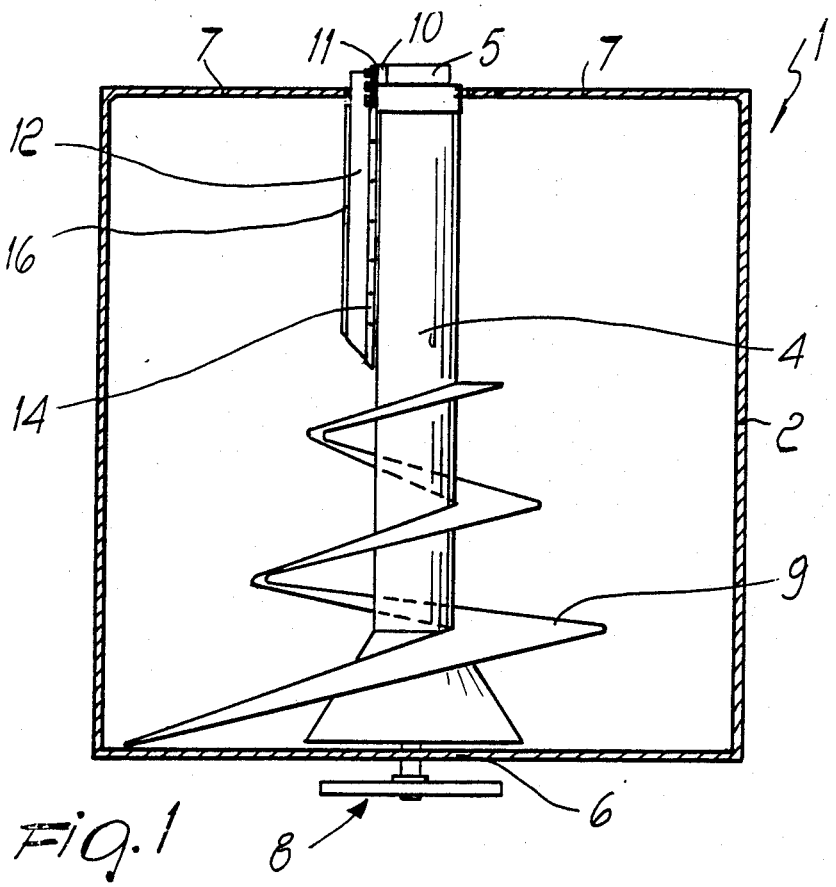
FIG. 1 is a schematic sectional view, taken along a diametrical plane, of a cylindrical mixer provided with the improvements according to the invention.
Figure 2:
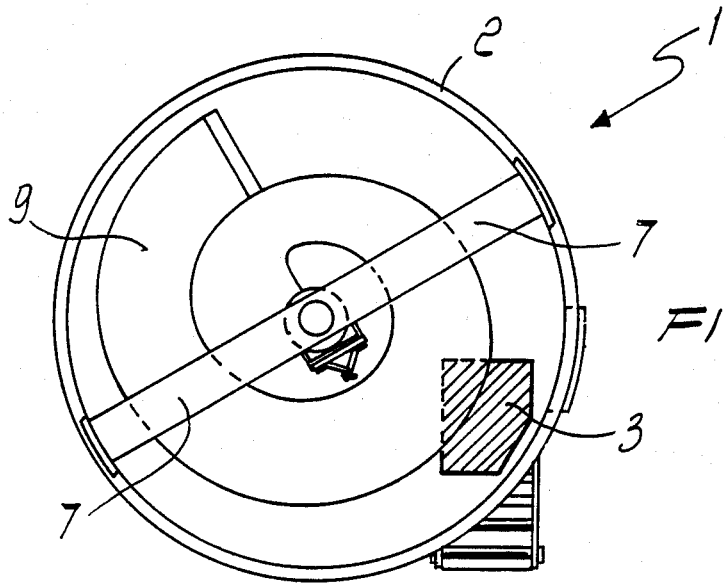
FIG. 2 is a schematic top view of the mixer of FIG. 1.
Figure 3:
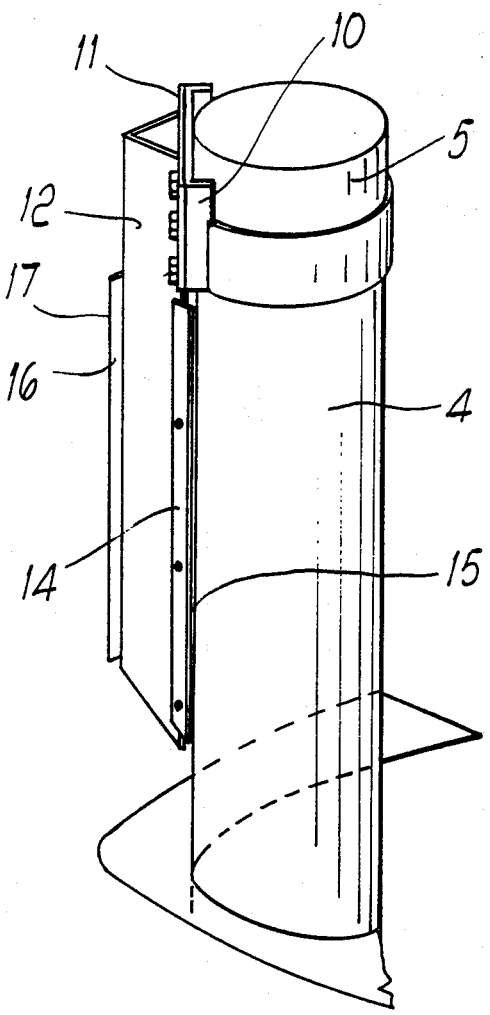
FIG. 3 is an enlarged-scale perspective view of the upper part of the screw supporting shaft, provided with the improvements according to the invention.
Figure 4:
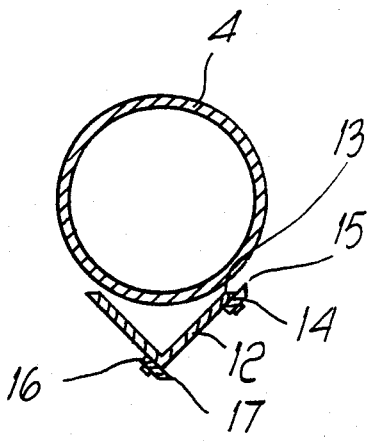
FIG. 4 is a sectional top plan view taken along the plane IV—IV of FIG. 3.

With reference to the above described figures, a known mixer is generally indicated by the reference numeral 1 and essentially comprises an upwardly open substantially cylindrical container 2 which can be conveniently downwardly fixed to a fixed or wheeled supporting plate and is furthermore downwardly provided with a discharge port 3 with a hydraulically controlled dosage shutter.

Said container 2 is internally provided with a tubular shaft 4 which is arranged vertically and is rotationally associated with end pins, respectively an upper pin 5 and a lower pin 6, both of which have bearings; the first pin is welded to radial spokes 7 arranged at the top of said container 2, while the second pin is integral with the bottom of said container.

Said shaft 4 is connected to a mechanical transmission 8 which associates it with actuation elements adapted to rotate it.

A screw 9 is welded and/or bolted to said shaft and extends from the lower part of the container 2 up to a portion of the shaft 4 which is spaced from the top; said screw has a helical profile arranged along an ideal conical surface.

According to the invention, laterally to said upper pin 5, which is substantially cylindrical, as illustrated in the figures, a plate-like support 10 is welded tangentially to the pin's outer surface and has perforations whereat a plate 11 is bolted; said plate 11 is welded to the upper end of a scraping element 12 which, in the present embodiment of the invention, is substantially composed by an L-shaped profiled element with identical wings.

Said L-shaped profiled element is conveniently welded to the plate 11, resting thereon with its outer edges, and extends downward, longitudinally flanking said shaft, to the top of said screws 9.

A scraping blade 14 is longitudinally bolted to the edge 13 of the scraper element 12 which is first encountered by the points of the surface of the shaft 4 during rotation; said blade has a cutting profile 15 adjacent to the outer surface of the shaft 4.

Still according to the invention, a blade 16 is longitudinally bolted at the connecting edge of the wings of said L-shaped profiled element and has a cutting profile 17 which also faces against the direction of rotation of said shaft 4.

The function of said blades 14 and 16 is to prevent the tangling of the fibrous materials being mixed, by performing thereon a shredding action which keeps the shaft 4 clean, thus avoiding stops during processing or an uneven mixing action.

The cleaning action performed by the blades also reduces the power consumption of the actuation motors, which would otherwise operate against considerable rotation-opposing forces caused by the presence of considerable tangled masses.

The aim and objects of the present invention are therefore brilliantly achieved.

The same improvements according to the invention may naturally be also applied to mixers which have more than one screw.

The invention thus conceived is susceptible to numerous modifications and variations, all of which are within the scope of the inventive concept; thus, for example, the blades may extend along the entire length of the scraping element, or on parts thereon, and may be divided into one or more sections.

All the details may furthermore be replaced with other technically equivalent elements.

In practice, the materials employed, as well as the dimensions, may be any according to the requirements.

I claim:

1. Improvements in a mixer particularly for fibrous products, comprising a mixing container internally provided with at least one vertical screw welded to a shaft which rotates about end pins fixed to said container, said mixer furthermore comprising at least one scraping element fixed to at least one of said pins and extending longitudinally adjacent to said shaft, said at least one scraping element having at least one blade associated therewith, extending substantially parallel to the surface of said shaft to scrape the surface of said shaft and at least one further blade which is spaced from said surface, extending in a direction substantially perpendicular to that of said blade.

2. Mixer according to claim 1, wherein said scraping element is fixed to the upper rotation pin and extends downward at the region of said shaft which is not occupied by said screw.

3. Mixer according to claim 1, wherein said scraping element is constituted by an L-shaped profiled element with identical wings, welded at one end, by means of the edges of said wings, to a plate which is in turn bolted to a plate-like support welded to said pin, said edges of said wings of said profiled element extending downward parallel to the surface of said shaft.

4. Mixer according to claim 3, wherein said at least one scraping blade is fixed with bolts at least at one edge of the wings of said scraping element.

5. Mixer according to claim 3, wherein said at least one blade which is spaced from the surface of said shaft is fixed with bolts to said scraping element at the connecting edge of said wings of said L-shaped profiled element.

6. Mixer according to claim 1, wherein said blades have at least one cutting profile.

* * * * *